United States Patent [19]

Tanabe

[11] 4,295,028

[45] Oct. 13, 1981

[54] COMBINATION OF GAS SENSOR CONTROLLED COOKING UTENSIL AND GAS LEAK ALARM

[75] Inventor: Takeshi Tanabe, Higashiosaka, Japan

[73] Assignee: Sharp Kabushiki Kaisha, Osaka, Japan

[21] Appl. No.: 123,278

[22] Filed: Feb. 21, 1980

[30] Foreign Application Priority Data

Feb. 23, 1979 [JP] Japan ..... 54-21061

[51] Int. Cl.[3] ..... H05B 6/68

[52] U.S. Cl. ..... 219/10.55 B; 219/10.55 R; 219/490; 340/634

[58] Field of Search ..... 219/10.55 B, 10.55 R, 219/490, 497, 502; 340/634, 632

[56] References Cited

U.S. PATENT DOCUMENTS

| | | | |
|---|---|---|---|
| 3,236,284 | 2/1966 | Kemper | 340/632 X |
| 3,609,732 | 9/1971 | Kasahara | 340/634 |
| 4,007,456 | 2/1977 | Paige et al. | 340/634 X |

FOREIGN PATENT DOCUMENTS

| | | | |
|---|---|---|---|
| 52-13150 | 2/1977 | Japan | 219/10.55 B |
| 54-134599 | 10/1979 | Japan | 340/634 |
| 54-146040 | 11/1979 | Japan | 219/10.55 R |
| 54-146042 | 11/1979 | Japan | 219/10.55 B |

*Primary Examiner*—Gene Z. Rubinson
*Assistant Examiner*—Keith E. George
*Attorney, Agent, or Firm*—Birch, Stewart, Kolasch and Birch

[57] ABSTRACT

A microwave oven includes a magnetron, a blower fan system, and a gas sensor for detecting an exhaustion gas concentration developed from an oven cavity. When the exhaustion gas concentration exceeds a preselected value while an actual cooking operation is conducted, the gas sensor develops a first detection output to complete the actual cooking operation. While the actual cooking operation is not conducted, the gas sensor functions as a gas leak alarm sensor. When an ambience gas concentration shows an abnormal value, the gas sensor develops a second detection output to announce a dangerous gas leakage. While the actual cooking operation is not conducted, the blower fan system is intermittently energized to introduce the ambience air toward the gas sensor for monitoring purposes.

4 Claims, 5 Drawing Figures

COMBINATION OF GAS SENSOR CONTROLLED COOKING UTENSIL AND GAS LEAK ALARM

BACKGROUND AND SUMMARY OF THE INVENTION

The present invention relates to a cooking utensil which includes a gas sensor for automatic cooking control purposes.

A microwave oven is proposed in my copending application Ser. No. 71,179, "COOKING UTENSIL CONTROLLED BY GAS SENSOR OUTPUT", filed on Aug. 31, 1979, wherein a gas sensor is disposed in an exhaustion duct for detecting a gas concentration developed from an oven cavity. When the gas concentration reaches a preselected value, the gas sensor output shows a preselected value, and in response thereto the microwave generation is terminated.

Since the gas sensor is also effective to detect the gas leakage, it is desirable to make such a microwave oven operate as a gas leak alarm when the microwave oven does not perform the cooking operation. However, the system must be constructed so that an ambience gas is properly introduced near the gas sensor while the microwave oven does not perform the cooking operation.

Accordingly, an object of the present invention is to provide a combination of a gas sensor output controlled cooking utensil and a gas leak alarm.

Another object of the present invention is to provide a control circuit for making a cooking utensil employing a gas sensor to operate as a gas leak alarm when the cooking utensil does not perform an actual cooking operation.

Still another object of the present invention is to provide a gas leak alarm system incorporated in a microwave oven which includes a gas sensor for automatic cooking control purposes.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a gas sensor is disposed in a path of the gas exhausted from an oven cavity. A control circuit is provided for terminating the microwave generation when an output voltage signal of the gas sensor reaches a preselected value.

A blower fan system is provided for introducing fresh air into the oven cavity and for developing the exhaust gas from the oven cavity while the microwave oven performs the actual cooking operation. When the microwave oven does not perform the actual cooking operation, the gas sensor control system is continuously supplied with power for gas leakage detection purposes, and the blower fan system is intermittently activated to intermittently introduce the ambience air toward the gas sensor for gas leakage detection purposes. The intermittent activation of the blower fan system ensures an accurate detection operation of the gas sensor, and minimizes the power consumption.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
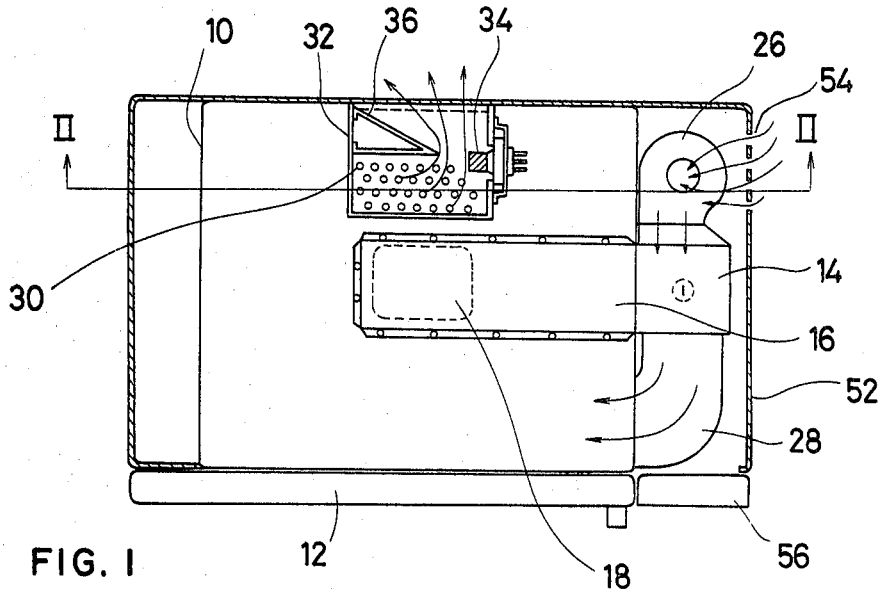
FIG. 1 is a sectional view of an embodiment of a combined cooking utensil and gas leak alarm of the present invention.
Figure 2:
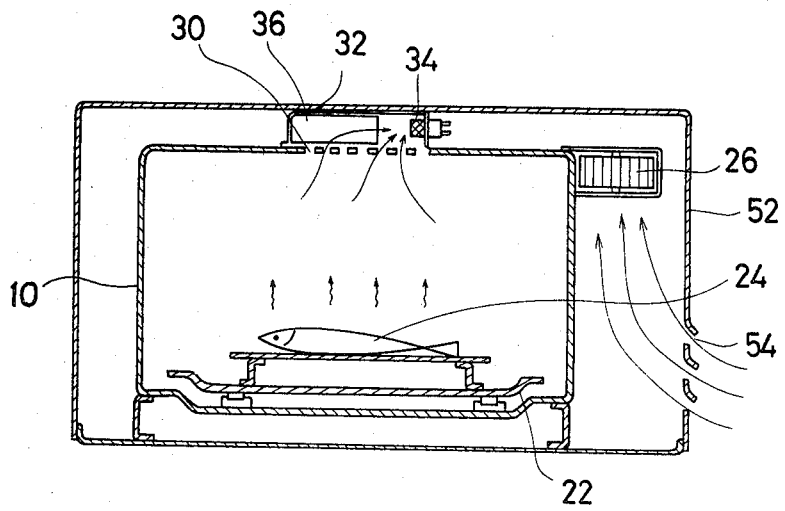
FIG. 2 is a sectional view of the combined cooking utensil and gas leak alarm taken along line II—II of FIG. 1.

FIGS. 1 and 2 show an embodiment of a combination of a gas sensor output controlled cooking utensil and a gas leak alarm of the present invention.

The combination of the present invention mainly comprises an oven wall 10 for defining an oven cavity, and an oven door 12. A magnetron 14 is secured to the oven wall 10 for supplying the microwave energy into the oven cavity through a wave guide 16 and an energy supply outlet 18. A tray 22 is disposed at the bottom of the oven cavity for supporting a foodstuff 24 to be cooked in the oven cavity. A blower fan 26 is provided to cool the magnetron 14. The air flow generated by the blower fan 26 is introduced into the oven cavity through an air duct 28. The thus introduced air is exhausted from the oven cavity through exhaustion openings 30 which are formed in the upper wall of the oven cavity. An exhaustion duct 32 is secured to the upper wall of the oven cavity to cover the exhaustion openings 30. A gas sensor 34 is secured to the exhaustion duct 32 for detecting the concentration of the gas exhausted from the oven cavity. A guide plate 36 is disposed in the exhaust duct 32 for directing the exhausted gas toward the gas sensor 34.

The combination of FIG. 1 further comprises a casing 52 for accomodating the above-mentioned elements. An air inlet opening 54 is formed in the casing 52 for introducing the ambience air toward the blower fan 26. A control panel 56 is disposed on the front wall of the cooking utensil for introducing various control commands into the combination of the cooking utensil and the gas leak alarm.

Figure 3:
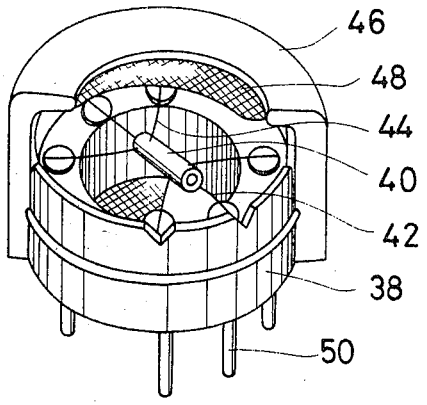
FIG. 3 is a perspective view of an embodiment of a gas sensor included in the combined cooking utensil and gas leak alarm of FIG. 1.

FIG. 3 shows an embodiment of the gas sensor 34.

The gas sensor 34 mainly comprises a resin block 38, a sensor 40, a heater coil 42, lead wires 44, a cover 46 including a gauze 48, and an input/output socket 50. A preferred gas sensor is "TGS#813" manufactured by Figaro Engineering Inc.

Figure 4:
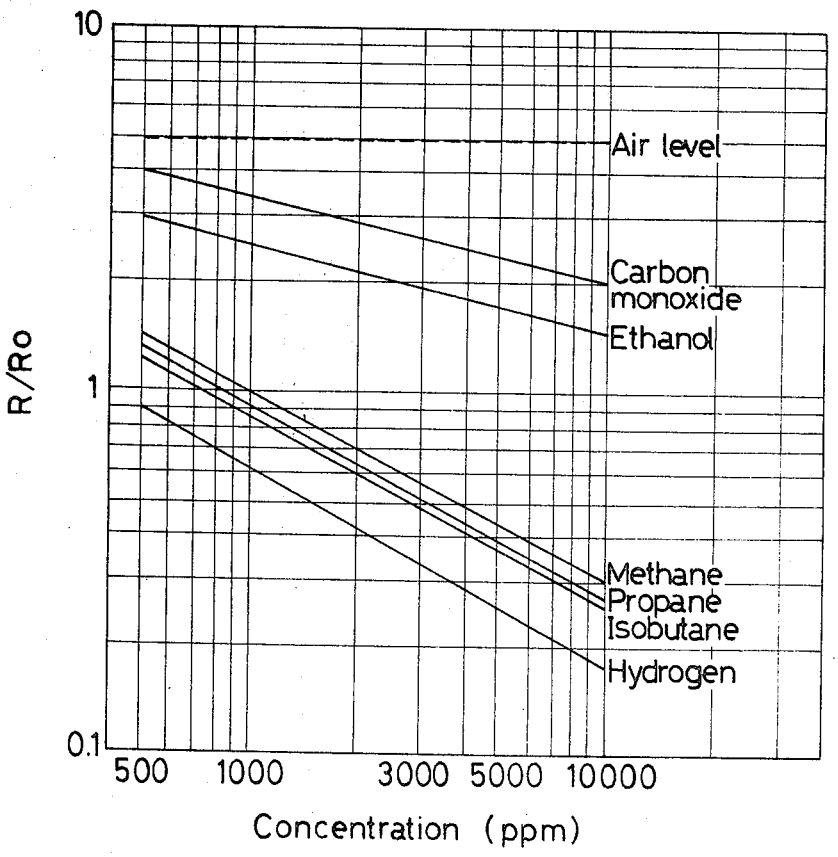
FIG. 4 is a chart showing the gas concentration response characteristic of the gas sensor of FIG. 3.

FIG. 4 shows the relationship between the gas concentration (along the abscissa axis) and the ratio of resistance ($R/R_o$) of the sensor (along the ordinate axis), wherein "$R_o$" is the sensor resistance in air containing 1000 ppm of methane, and "R" is the sensor resistance at different concentrations of gases.

The present invention is to utilize the above variations of the sensor resistance for determining the completion of the cooking operation, and for detecting an abnormal gas concentration due to the gas leakage while the cooking utensil does not perform the cooking operation. To properly detect a dangerous gas leakage from gas combustion apparatus disposed in the kitchen, a control circuit must be constructed to develop an alarm signal when the gas concentration of propane or isobutane exceeds 2,000 ppm, or when the gas concentration of methane exceeds 5,000 ppm.

Figure 5:
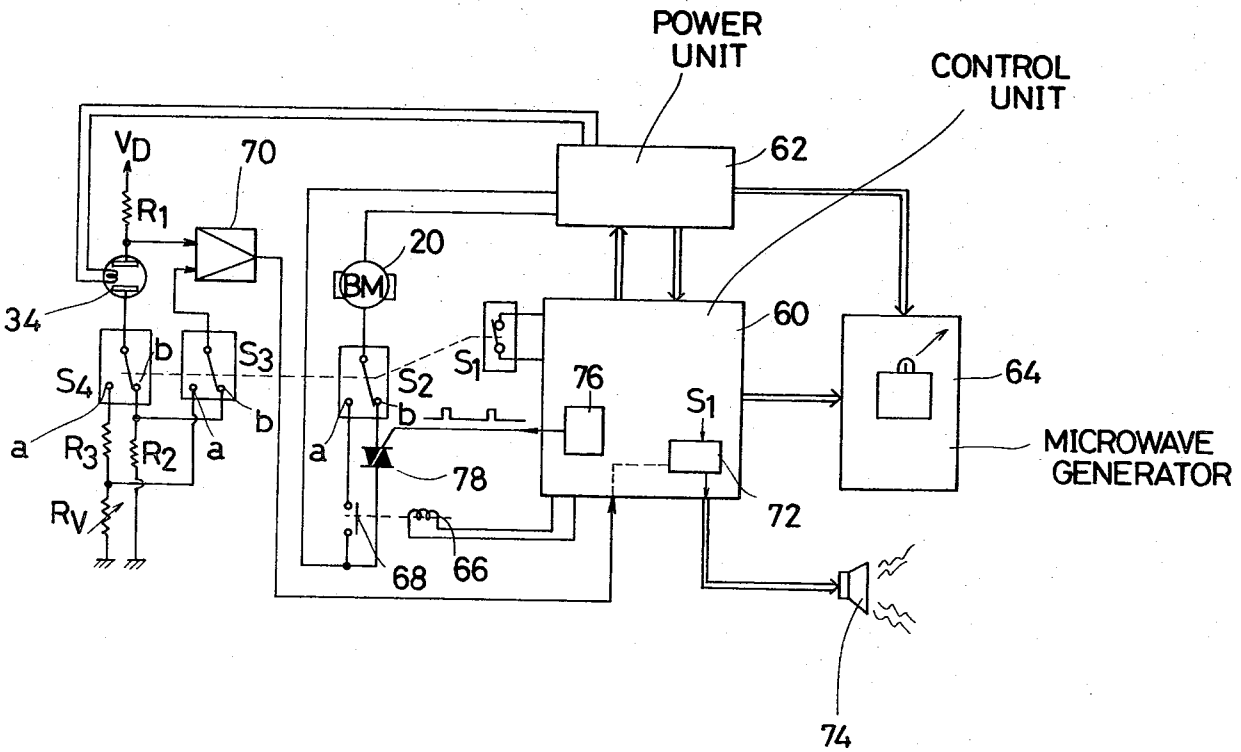
FIG. 5 is a block diagram of an embodiment of a control circuit of the combined cooking utensil and gas leak alarm of the present invention.

FIG. 5 shows an embodiment of a control circuit of the present invention, which responds to the gas sensor output.

The control circuit mainly comprises a semiconductor control unit 60, a power supply unit 62, a microwave generation control circuit 64 to activate the magnetron 14 (See FIG. 1) for cooking purposes, and a blower motor 20 for activating the blower fan 26 (See FIG. 1).

An output voltage signal of the gas sensor 34 is applied to a detection input terminal of a comparator 70. As already discussed above the output voltage signal of the gas sensor 34 varies in response to the concentration of the gas introduced near the gas sensor 34.

When the combination cooking utensil and gas leak alarm operates as the cooking utensil, a manual switch $S_1$ is open and, therefore, interlocked switches $S_2$, $S_3$ and $S_4$ are placed in the condition where movable contacts thereof are made contact with first terminals a. A variable resistor $R_v$ determines a reference voltage to be applied to a reference input terminal of the comparator 70. When a cook start switch is actuated, the semiconductor control unit 60 develops control signals for activating the microwave generation control circuit 64, and for activating a relay 66, thereby closing a relay switch 68. Accordingly, the blower motor 20 is continuously activated to introduce a fresh air into the oven cavity and to force the gas exhausted from the foodstuff to flow toward the gas sensor 34. When the gas sensor output voltage signal reaches a preselected reference level determined by the variable resistor $R_v$, the comparator 70 develops a detection output.

Upon development of the detection output from the comparator 70, the semiconductor control unit 60 develops control signals for deenergizing the microwave generation control circuit 64 and the relay 66, thereby completing the cooking operation. An alarm circuit 72 activates a buzzer 74 to announce the completion of the cooking operation.

The resistance value of the variable resistor $R_v$ is selected at a desired value in accordance with the kind of foodstuff to be cooked. Resistors $R_1$ and $R_3$ are provided for ensuring a stable detection operation of the gas sensor 34. A typical cooking control operation in the microwave oven including a gas sensor is disclosed in my copending application Ser. No. 71,179, "COOKING UTENSIL CONTROLLED BY GAS SENSOR OUTPUT", filed on Aug. 31, 1979.

When the actual cooking operation is not performed, the manual switch $S_1$ is closed to place the system in a gas leak alarm operation mode. The movable contacts of the interlocked switches $S_2$, $S_3$ and $S_4$ are made contact with second terminals b. A resistor $R_2$ functions to apply a reference voltage signal to the reference input terminal of the comparator 70, the reference voltage signal being a preferred level suited for detecting the dangerous gas leakage.

When the manual switch $S_1$ is closed, a timer circuit 76 included in the semiconductor control unit 60 develops a control signal having a predetermined time interval for switching a thyristor 78. Accordingly, the blower motor 20 is intermittently energized to intermittently introduce the ambience air into the combination cooking utensil and the gas leak alarm for ensuring a reliable detection operation of the gas sensor 34. When an abnormal gas concentration is detected by the gas sensor 34, the comparator 70 develops a detection output to activate the alarm circuit 72. Since the alarm circuit 72 receives another control signal from the manual switch $S_1$, the alarm circuit 72 develops an activation signal, which is different from the signal for announcing the completion of the cooking operation, toward the buzzer 74. In this way, the buzzer 74 develops an alarm sound for alarming the gas leakage.

The above-mentioned present invention will be effectively accomplished in a microcomputer controlled microwave oven, which includes a time keeping circuit to which the electric power is continuously supplied even when the actual cooking operation is not performed.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A combined cooking utensil and gas leak alarm comprising:

an oven cavity;

a cooking energy source for conducting the cooking operation of a foodstuff disposed in said oven cavity;

a blower fan system for introducing a fresh air into the oven cavity and exhausting gas from said oven cavity;

a gas sensor disposed in a path of the gas developed from said oven cavity for detecting the gas concentration;

a control circuit for controlling the operation of said cooking energy source in response to an output signal derived from said gas sensor when said combined cooking utensil and gas leak alarm is placed in a cooking operation mode;

a monitor circuit for detecting an ambience gas concentration through the use of said gas sensor when said combined cooking utensil and gas leak alarm is placed in a gas leak alarm operation mode, said monitor circuit developing an alarm instruction output when the ambience gas concentration exceeds a preselected value; and an alarm system responding to said alarm instruction output derived from said monitor circuit.

2. The combined cooking utensil and gas leak alarm of claim 1, wherein said blower fan system is intermittently energized when the combined cooking utensil and gas leak alarm is placed in said gas leak alarm operation mode.

3. The combined cooking utensil and gas leak alarm of claim 1 or 2, wherein said cooking energy source comprises a magnetron for conducting the microwave cooking.

4. The combined cooking utensil and gas leak alarm of claim 3, wherein said blower fan system functions to cool the magnetron when the combined cooking utensil and gas leak alarm is placed in said cooking operation mode.

* * * * *